United States Patent [19]

Yoshizawa et al.

[11] Patent Number: 4,769,091

[45] Date of Patent: Sep. 6, 1988

[54] MAGNETIC CORE

[75] Inventors: Yoshihito Yoshizawa; Shin Nakajima; Kiyotaka Yamauchi, all of Kumagaya, Japan

[73] Assignee: Hitachi Metals Ltd., Tokyo, Japan

[21] Appl. No.: 85,405

[22] Filed: Aug. 10, 1987

Related U.S. Application Data

[62] Division of Ser. No. 898,309, Aug. 20, 1986, abandoned.

[30] Foreign Application Priority Data

Aug. 20, 1985 [JP] Japan ..... 60-182330
Sep. 20, 1985 [JP] Japan ..... 60-208328

[51] Int. Cl.[4] ..... C21D 1/04; H01F 1/04
[52] U.S. Cl. ..... 148/108; 148/121
[58] Field of Search ..... 148/108, 103, 121

[56] References Cited

U.S. PATENT DOCUMENTS 4,081,298 3/1978 Mendelsohn et al. ..... 148/108
4,249,969 2/1981 De Cristofaro et al. ..... 148/108
4,379,004 4/1983 Makino et al. ..... 148/108

*Primary Examiner*—Wayland Stallard
*Attorney, Agent, or Firm*—Antonelli, Terry & Wands

[57] ABSTRACT

A magnetic core comprised of an amorphous metal alloy having a composition represented by the formula:

$$(Co_{1-a-b-c}Fe_aMn_bMo_c)_{100-x-y}Si_xB_y \text{ (in atomic \%)}$$

wherein a, b, c, x and y are numbers which respectively satisfy relations $0 \leqq a \leqq 0.05$, $0.03 \leqq b \leqq 0.08$, $0.01 \leqq c \leqq 0.04$, $0.04 \leqq b+c \leqq 0.10$, $14 \leqq x \leqq 16$ and $7.5 \leqq y \leqq 9.5$, and the core is treated by a process including a step to keep the core at least one time at a temperature between $0.95 \times Tc$ and 150° C. for a time of one hour to ten hours in a magnetic field, the direction of which is generally coincidental with the direction of the magnetic path in the core.

3 Claims, 8 Drawing Sheets

MAGNETIC CORE

This is a division of application Ser. No. 898,309 filed 8/20/86 and now abandoned.

BACKGROUND OF THE INVENTION (1) Field of the Invention

The present invention relates to a magnetic core for a saturable reactor and others to be incorporated in a magnetically controllable switching mode of power source and others where the magnetic core is used to control its out-put voltage. More particularly, it relates to a magnetic core having excellent magnetization characteristics for the control during its operation in a high frequency of alternating-current(AC) magnetic field, a high rectangular ratio(Br/Bs), a low core loss(W) and a low disaccommodation of its magnetic characteristics.

(2) Description of the Prior Art

Because of recent development of electronic devices, switching power sources carrying a magnetic amplifier have been getting more and more widely used. A main portion constituting a magnetic amplifier is a saturable reactor comprising a magnetic core including a metal ribbon wound into a toroidal shape. Magnetic core materials provided with a high saturation flux density Bs and a high rectangular ratio Br/Bs where Br represents a residual magnetic flux density are now desired to use for cores of the saturable reactors in switching power sources. Heretofore, there have been used 50% Ni-Permalloys, 80% Ni-Permalloys, etc. But they fail to meet the recent high frequency requirements of switching power sources which have increasingly high performance with reduced size and weight. Specifically, 50% Ni-Permalloys and 80% Ni-Permalloys suffer enormous core loss when they are used in a high frequency magnetic field. So, magnetic core materials excellent in high frequency characteristics have been required.

A proposal has been made to provide a magnetic core comprising a heat-treated Co-base amorphous alloy ribbon wound into a toroidal shape to overcome the abovestated disadvantages of 50% Ni-Permalloys and 80% Ni-Permalloys as described in U.S. Pat. No. 4,473,417. One method of heat treatments applied to Co-base amorphous alloy is to quench it after keeping it at a temperature higher than its Curie temperature(Tc).

Although amorphous alloys processed by the above heat treatment may have a low initial core loss, they suffer a low rectangular ratio(Br/Bs), a low magnetic anisotropy, and a big disaccommodation of core loss. At a result, saturable reactors made of such materials have a tendency to become uncontrollable because of its excessive heat generation, also causing undesirable effects on the neighboring elements in a switching power source.

It was also proposed to treat a Co-base amorphous alloy ribbon at a temperature below its Curie temperature where the alloy remains magnetic, from the aspect that a Co-base amorphous alloy is easily provided with an inductive magnetic anisotropy, because an amorphous state is a metastable state metallurgically. In the above-mentioned case, an amorphous metal alloy ribbon having a low core loss is produced by a rapid quench of a melt, then heat-treated at a temperature below its Curie temperature in a magnetic field in order to enhance its rectangular ratio Br/Bs.

However, it was recently recognized that a toroidal core comprised of an amorphous alloy which was heat-treated by the above-mentioned method has a big rectangular ratio and a small disaccommodation of core loss, but the core loss thereof is bigger than those of amorphous alloy heat-treated at a temperature above its Curie temperature.

The other proposals to improve its magnetic characteristics have been made to provide a magnetic core comprising a heat-treated Co-base amorphous alloy ribbon wound into a toroidal shape in Japan Patent Publications Nos. 60-19125, 58-1183 and 59-29644. Amorphous metal ribbons having a composition represented by a formula: $(Fe, Ni, Co)_{90-70}(Si,B, P, C)_{30-10}$ in Japan Patent Publication No. 60-19125 and a formula: $(Fe, Ni)_{0.1-40}Si_{3-16}B_{5-24}$ in Japan Patent Publication No. 58-1183 are subjected to a heat-treatment to cool them in a magnetic field or to cool them rapidly in an air. In Japan Patent Publication No. 59-29644, a heat-treatment in a magnetic-field for an amorphous metal alloy is disclosed. The aim of the treatment is to reduce a coercive force in a direct-current(DC) B-H curve of an amorphous metal alloy, where the amorphous metal alloy is cooled at a cooling rate in a predetermined temperature range. However it is more important to reduce a coercive force in an alternating-current(AC) B-H curve of an amorphous metal alloy from a practical point of view. It is also important to reduce an iron loss of an amorphous metal alloy and to provide it with a high rectangular ratio(Br/Bs) where Br is a residual magnetic flux density and Bs is a saturation flux density, measured in a high frequency magnetic field of 50 KHz or more.

OBJECT AND SUMMARY OF THE INVENTION

Accordingly, it is an object of the present invention to present a magnetic core having excellent characteristics for a saturable reactor to be incorporated in a switching mode of power source where the magnetic core is operated in a high frequency of magnetic field of 50 KHz or more.

It is another object of the invention to present a magnetic core having excellent magnetization characteristics for a control during its operation in a high frequency of magnetic field of 50 KHz or more to be incorporated in a magnetically controllable switching mode of power source.

It is other object of the invention to present a magnetic core provided with a high core gain and a rather small rise of core temperature, which is important characteristics to reduce the re-set current and to enhance its reliability when it is incorporated in a switching mode of power source.

According to this invention, there is provided a magnetic core comprised of an amorphous metal alloy ribbon formed into a toroidal. The composition of the amorphous metal alloy can be described by the furmula:

$$(Co_{1-a-b-c}Fe_aMn_bMo_c)_{100-x-y}Si_xB_y \text{ (in atomic \%)}$$

wherein a, b, c, x and y are numbers which respectively satisfy relations $0 \leqq a \leqq 0.05$, $0.03 \leqq b$ 0.08, $0.01 \leqq c \leqq 0.04$, $0.04 \leqq b+c \leqq 0.10$, $14 \leqq X \leqq 16$ and $7.5 \leqq Y \leqq 9.5$, and the core is treated by a process comprising the steps of:

(a) keeping the core at a temperature above the alloy's Curie temperature(Tc);

(b) slowly cooling it through the Curie temperature(Tc) in a DC or AC magnetic field, the direction of which is generally coincidental with the direction of the magnetic path in the core, where the cooling rate is a value of 0.1° C./minute to 50° C./minute;

(c) keeping the core at least one time at a temperature between 0.95×Tc and 150° C. for one hour to ten hours in a magnetic field, the direction of which is generally coincidental with the direction of the magnetic path in the core; and (d) cooling the core to a room temperature.

DESCRIPTION OF THE PREFERRED EMBODIMENTS

Figure 1:
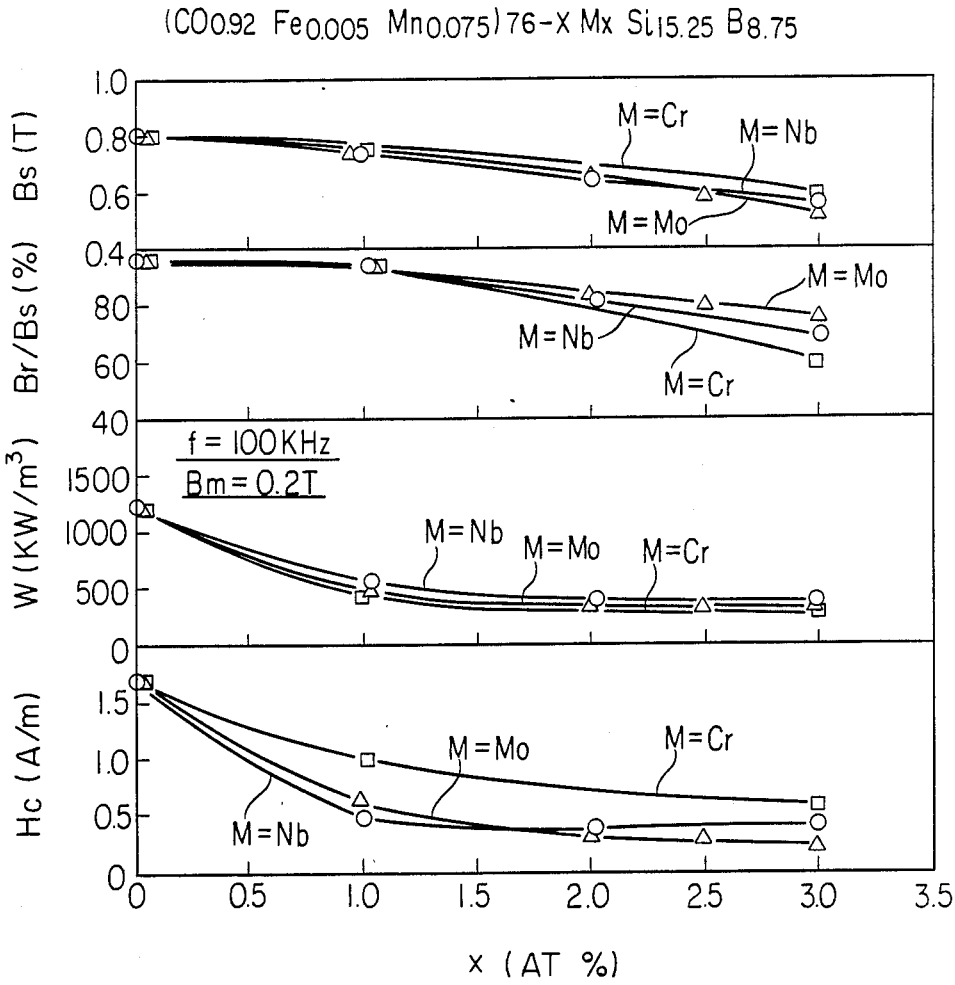
FIG. 1 is a graph showing the effect of an addition of M-element on a coercive force (Hc), an iron loss (W), a rectangular ratio (Br/Bs) and a saturation flux density (Bs) of an amorphous metal alloy having a composition formula, $$(Co_{0.92}Fe_{0.005}Mn_{0.075})_{76-x}M_xSi_{15.25}B_{8.95};$$

A Co-base amorphous metal is easily provided with a small coercive force (Hc) and a high rectangular ratio (Br/Bs) in contrast with a Fe-base amorphous metal. A Co-base amorphous metal can be provided with also an extremely small magnetostriction (λs) by a substitution of a small amount of Fe and Mn for Co.

Si addition is effective to reduce an iron loss but an excess addition of Si causes to lower the Curie temperature (Tc) and the rectangular ratio (Br/Bs) extremely. Because of the above mentioned facts, a preferable range of Si amount to be added to an amorphous metal is 14 to 16 atomic %.

The B content should fall within the range of between 7.5 to 9.5 atomic %, because it is rather difficult to produce an alloy in an amorphous state if the B content is less than 7.5 atomic %, and on the other hand the alloy would be provided with a low magnetic flux density if the B content in the alloy exceeds 9.5 atomic %. Although a saturation flux density (Bs) of an amorphous metal can be increased by a substitution of a small amount of Fe for Co in its composition, an excess substitution of Fe for Co causes a big disaccommodation of the magnetic characteristics. The a-value for Fe in the composition formula should be a value equal to or less than 0.05, to avoid the big disaccommodation of magnetic characteristics to be provided to an amorphous metal. An amorphous metal can be provided with an extremely small magnetostriction (λs) by a substitution of a small amount of Mn for Co, although a proper amount of Mn varies depending on the Fe amount in the amorphous metal. The b-value for Mn in the composition formula should be a value of 0.03 to 0.08, because an iron loss would be big if the b-value is less than 0.03 although an excess addition of Mn as b exceeds 0.08 makes the resulting alloy brittle.

An addition of Mo is effective to reduce a coercive force Hc in an alternating-current B-H curve and a disaccommodation of magnetic characteristics and to enhance magnetization characteristics for a control. The proper c-value of Mo to be added to the amorphous metal alloy according to the invention is a value of 0.01 to 0.04 in the composition formula:

$$(Co_{1-a-b-c}Fe_aMn_bMo_c)_{100-x-y}Si_xB_y.$$

Although the Mo addition contributes to reduce a coercive force Hc measured in an AC magnetic field, an excess addition of Mo causes a big deterioration of a residual magnetic flux density (Br) and a rectangular ratio (Br/Bs) of an amorphous alloy. Mo is much more effective to reduce a coercive force Hc measured in an alternating magnetic field of an amorphous metal alloy than Nb or Si, without a reduction of a rectangular ratio (Br/Bs).

The effect of Mo addition into an amorphous metal alloy can be enhanced by a heat-treatment according to the present invention. The heat-treatment comprises a step to keep a magnetic core at least one time at a temperature between 0.95×Tc and 150° C. for a time period of one hour to ten hours in a magnetic field, the direction of which is generally coincidental with the direction of the magnetic path in the core, after keeping the core at a temperature above the Curie temperature of the alloy in the core. The magnetic field to be applied to the core can be an alternating-current (AC) magnetic field or a direct-current (DC) magnetic field of 0.10e or more. A multi-stage aging of the core at a temperature between 0.95×Tc and 150° C. in a magnetic field is preferable. The strength of the magnetic field should be 0.1 Oe or more, because the heat-treatment at a temperature of 0.95×Tc to 150° C. would not effective in a magnetic field of less than 0.1 Oe. According to the present invention, a magnetic core can be provided with a low iron loss (W), preferable magnetization characteristics for a control and a high rectangular ratio (Br/Bs) by cooling it through its Curie temperature (Tc) in a magnetic field and keeping it at least one time at a temperature of 0.95×Tc to 150° C. in a magnetic field.

The present invention will be further explained by the following Examples.

EXAMPLE 1

Amorphous metal ribbons having about 20/μm of thickness, which have compositions described by the formula:

$$(Co_{0.92}Fe_{0.005}Mn_{0.075})_{76-x}M_xSi_{15.25}B_{8.75}$$

where produced by a rapid quenching process using a single roller. The sheets were wound to form cores each of which has a shape of an outer diameter of 35 mm, an inner diameter of 20 mm, and a height of 10 mm. The wounds core were heat-treated respectively in a magnetic field, direction of which was along the magnetic path of the core at a temperature above the Curie temperature (Tc), then maintained in a magnetic field at a temperature of about 0.8×Tc° C. during 1.5 hours and subsequently cooled to a room temperature. Various compositions of alloys were used to produce magnetic cores to examine the composition dependence on the rectangular ratio (Br/Bs), the iron loss (W) and the coercive force (Hc) measured in an alternating magnetic field of 50 KHz. The dependences of the rectangular ratio (Br/Bs), the iron loss (W), and the coercive force (Hc) measured in an alternating magnetic field of 50 KHz versus the element M and the M's x-value are shown in FIG. 1. The selection of Cr for M-element is not preferable because Cr lowers the rectangular ratio (Br/Bs) extremely although it reduces the iron loss (W) and the coercive force (Hc). The selection of Nb for M-element is also not preferable because it lowers the rectangular ratio (Br/Bs) much more than the case to use Mo. The selection of Mo for M-element is much preferable because the lowering of the rectangular ratio (Br/Bs) by the Mo addition is rather small compared with the cases of Cr or Nb addition and Mo is effective to reduce the coercive force (Hc) in an alternating-current B-H curve measured in an alternating magnetic field of 50 KHz and the iron loss (W).

EXAMPLE 2

An amorphous metal sheet having about 18 μm of thickness, which has a composition described by the formula:

$$(Co_{0.89}Fe_{0.005}Mn_{0.072}Mo_{0.033})_{76}Si_{15.5}B_{8.5}$$

was produced by a rapid quenching process using a single roller, as in Example 1. The characteristics of the magnetic core (No.1) incorporated with the amorphous metal sheet are shown together with the characteristics of a core of 50% Ni-Permalloy (No.4), a core of 80% Ni-Permalloy (No.3) and a core of a referential amorphous metal having a composition formula:

$$Co_{70}Fe_{0.4}Mn_6Si_{13}B_{8.75}Nb_{1.85}\ (No.2)$$

in Table 1.

TABLE 1

| Sample No. | Thickness (μm) | Bs (T) | Br/Bs (%) | Hc (A/m) | $W_{0.2}$/100 K. (kW/m$^3$) | Tc (°K.) |
|---|---|---|---|---|---|---|
| No. 1 | 18 | 0.61 | 85 | 0.24 | 460 | 496 |
| No. 2 | 18 | 0.78 | 93 | 0.40 | 900 | 543 |
| No. 3 | 25 | 1.51 | 97 | 8.0 | 3800 | 773 |
| No. 4 | 25 | 0.80 | 60 | 0.88 | 1000 | 673 |

As shown in Table 1, the 80% Ni-Permalloy suffers a big iron loss when it is used in a high frequency of AC magnetic field as 20 KHz and the 50% Ni-Permalloy suffers a low rectangular ratio as 60%. They are not proper to be utilized for a magnetic core in a switching mode of power source which is moved at a high frequency of magnetic field. On the other hand, an amorphous metal having a composition formula: $(Co_{0.89}Fe_{0.005}Mn_{0.072}Mo_{0.033})_{76}Si_{15.5}B_{8.5}$ is provided with a high rectangular ratio of a value of 93% which is almost the same as one of 50% Ni-Permalloy and a smaller iron loss than one of the amorphous metal having a composition formula:

$$Co_{70}Fe_{0.4}Mn_6Si_{13}B_{8.75}Nb_{1.85}.$$

The amorphous metal No. 1 is provided with also a small disaccommodation as a 50% Ni-Permalloy. The proper frequency range of an alternating magnetic field to move the magnetic core is a value of 100 KHz to 500 KHz.

EXAMPLE 3

Figure 2:
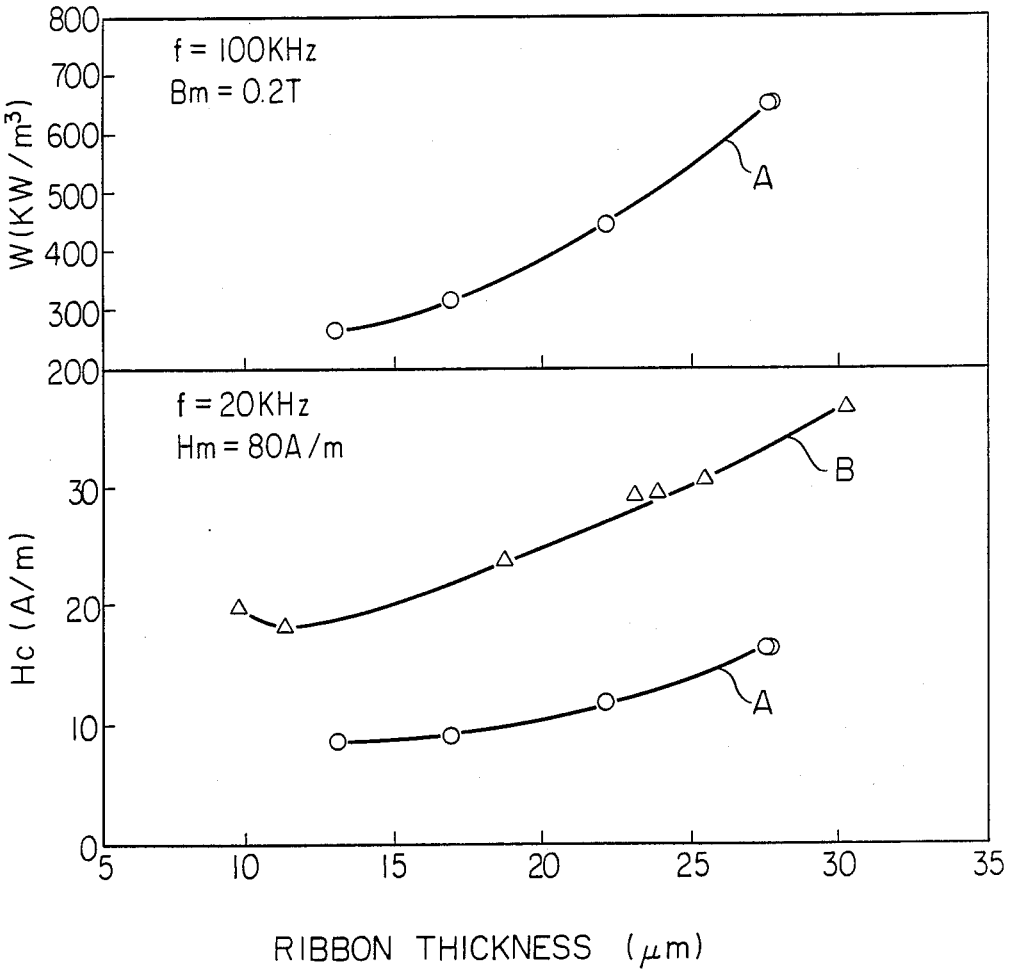
FIG. 2 is thickness dependences of a coercive force (Hc) and an iron loss of an amorphous metal ribbon.

We examined the coersive force (Hc) in an alternating current B-H curve measured in an AC magnetic field of 50 KHz, the iron loss (W) varying the thickness of the amorphous metal ribbon having a composition formula:

$$(Co_{0.895}Fe_{0.024}Mn_{0.048}Mo_{0.033})_{76}Si_{15}B_9$$

is a magnetic core as in Example 1. The experimental results (Curve A) are shown in FIG. 2. The reference date (Curve B) of a core incorporated with an amorphous metal ribbon having a composition formula:

$$Co_{70}Fe_{0.4}Mn_6Si_{13}B_{8.75}Nb_{1.85}$$

are also shown in FIG. 2. A magnetic core made of an amorphous metal ribbon having a thickness of 25μm or less is provided with a low coercive force (Hc) in an alternating-current B-H curve. But it is rather difficult to produce an amorphous metal sheet having a thickness of less than 5μm.

EXAMPLE 4

Figure 3:
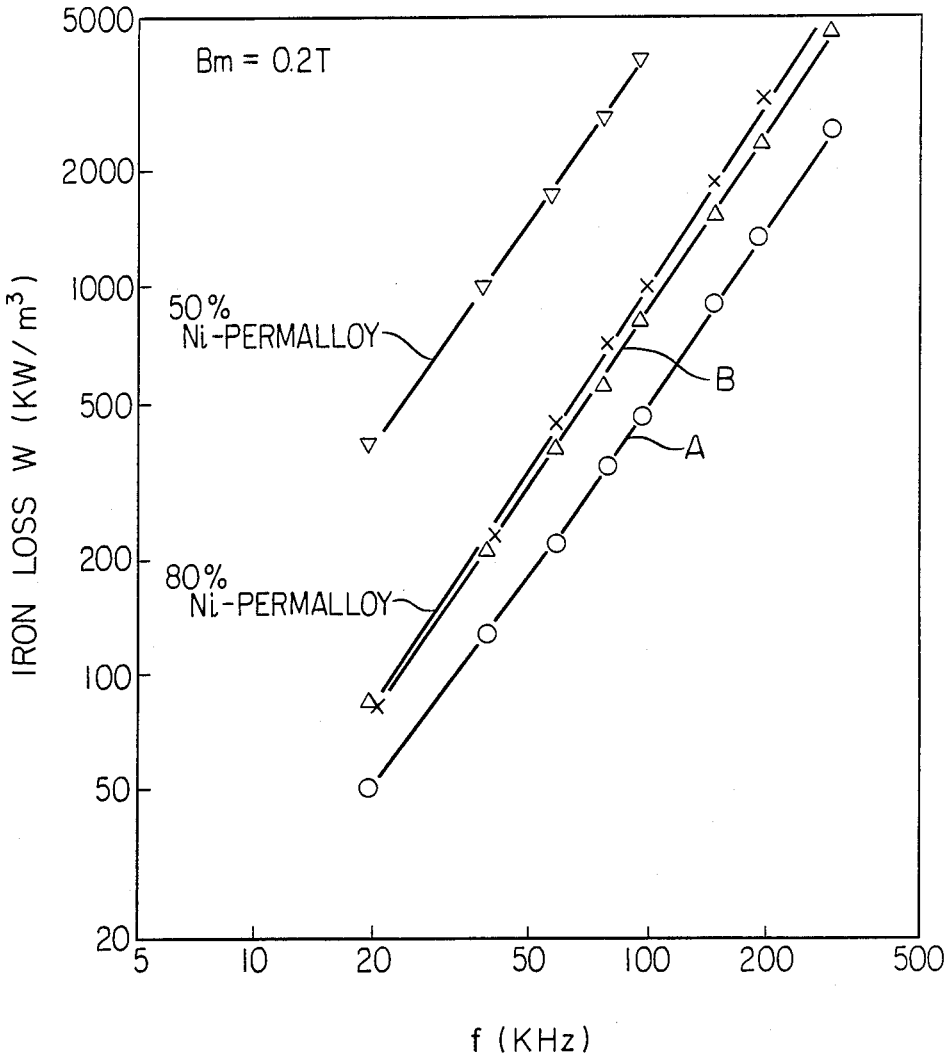
FIG. 3 is a graph to show the frequency dependence of an iron loss of the invented alloy, a referential amorphous alloy, 80% Ni-Permalloy and 50% Ni-Permalloy.
Figure 4:
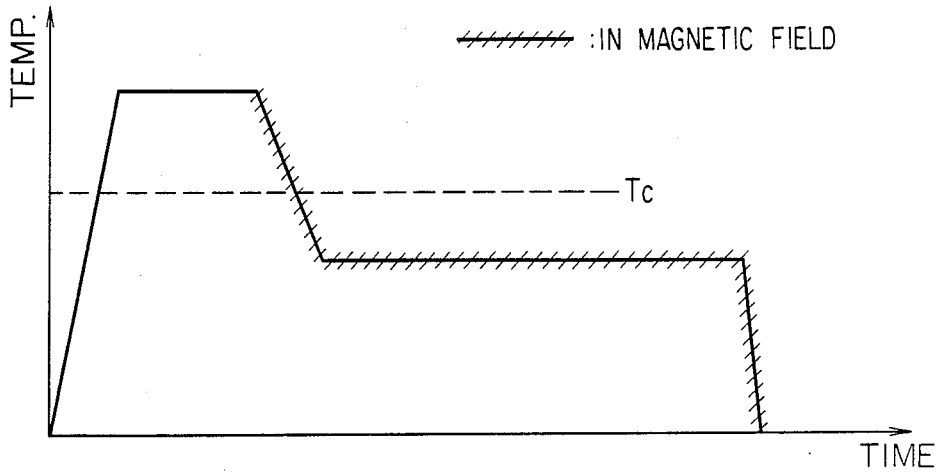
FIG. 4 shows a typical pattern of a heat-treatment according to the invention.

FIG. 3 shows the frequency dependence of the iron loss (W) in an alternating magnetic field of a magnetic core incorporated with an amorphous metal ribbon (A) according to the present invention, a reference core incorporated with an amorphous metal ribbon (B), a core of 50% Ni-Permalloy and a core of 80% Ni-Permalloy. In FIG. 3, the vertical scale shows the iron loss (W) represented in a logarithmic scale. The horizontal scale shows the frequency of an alternating magnetic field. As shown in FIG. 3, the core of the amorphous metal ribbon according to the present invention is proper to be moved at a high frequency of 100 KHz or 500 KHz because of a much lower iron loss than other materials, although the iron loss increases linearly as the frequency of magnetic field increases. The core incorporated with an amorphous metal alloy according to the present invention can be easily provided with a low iron loss as 500 KW/m$^3$. The typical pattern of the heat-treatment according to the present invention is shown in FIG. 4.

EXAMPLE 5

Figure 5:
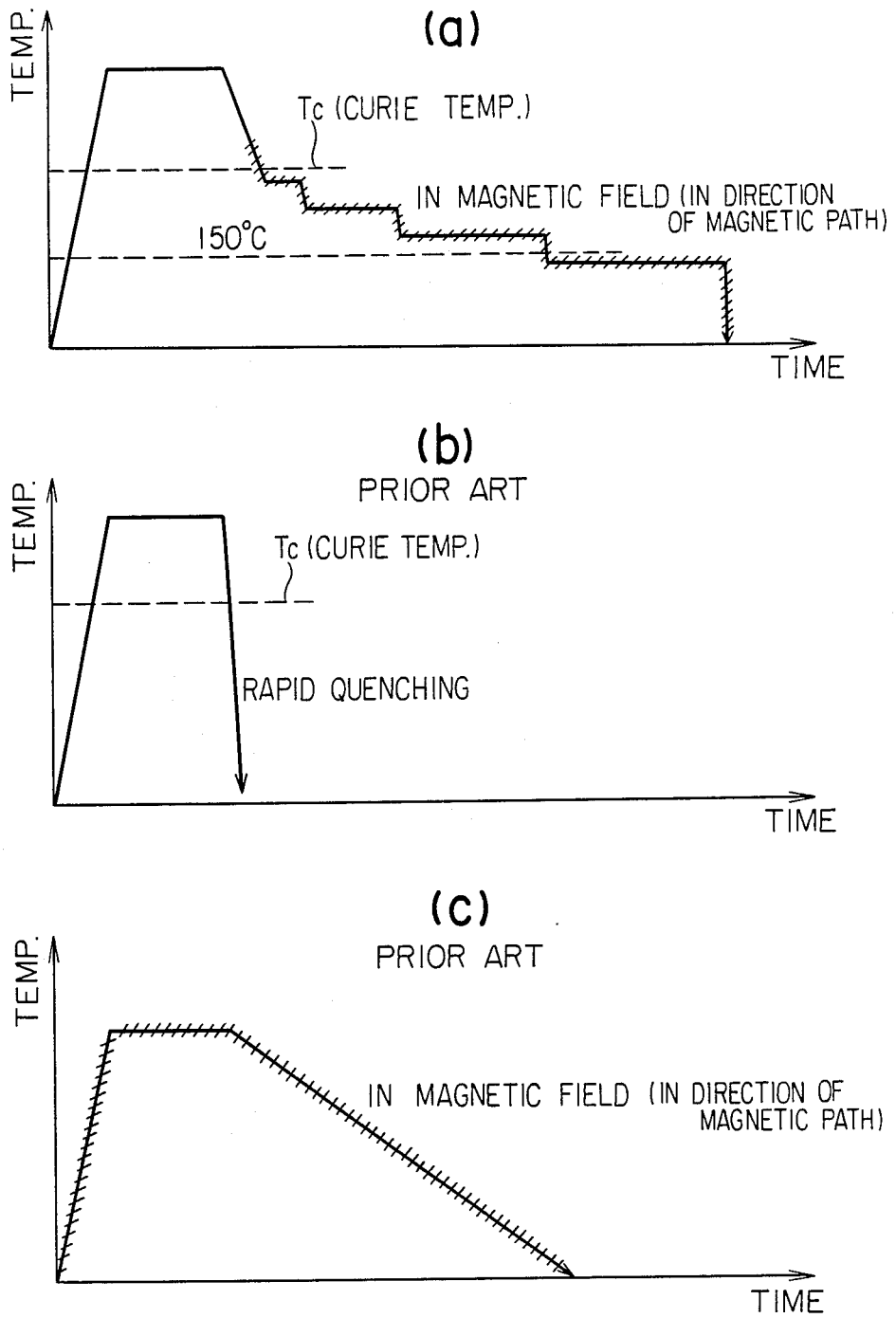
FIG. 5 shows a heat-treatment pattern according to the invention (a), a prior heat-treatment pattern (b) and another prior heat-treatment pattern (c)
Figure 6:
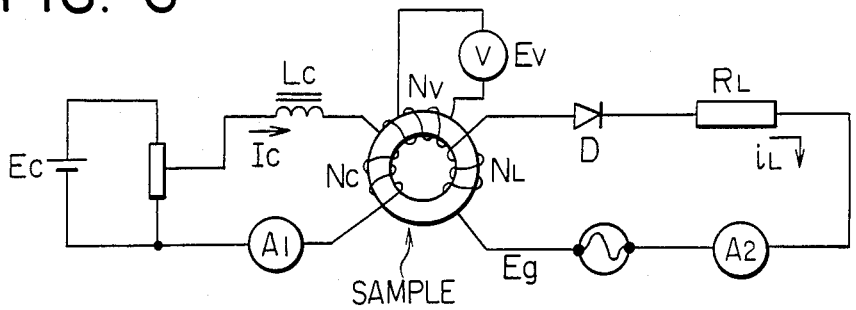
FIG. 6 shows a circuit to measure magnetization characteristics for a control.

A multi-stage aging in a magnetic field according to the invention is shown in FIG. 5(*a*). The prior patterns are shown in FIG. 5(*b*) and FIG. 5(*c*). In the treatment according to the invention, a magnetic core is kept at a temperature above its Curie temperature and it is cooled through the Curie temperature in a magnetic field, the direction of which is generally coincidental with the direction of the magnetic path of the core. Then it is kept at least one time at a temperature between 0.95×Tc and 150° C. in a magnetic field having almost the same direction as the direction of the magnetic path in the core. In a multi-stage aging, the aging temperature is lower as the aging is later. The magnetic field can be applied to the core beginning at any heat-treatment step at a temperature above the Curie temperature. The heat-treatment shown in FIG. 5(*b*) comprises a rapid quenching of a magnetic core to a room temperature, after keeping it at a temperature above its Curie temperature, by which the core suffers a low rectangular ratio, unfavorable magnetization characteristics and a big disaccommodation of magnetic characteristics, which make it unpractical. The heat-treatment shown in FIG. 5(*c*) comprises cooling a core in a magnetic field which provides the core with a low coercive force measured in a DC magnetic field and a high rectangular ratio, but with an unfavorable magnetization characteristics measured in a high frequency of AC magnetic field of 50 KHz or more. It is better for us to explain a circuit in FIG. 6 to measure the magnetization characteristics of a core measured in a high frequency of magnetic field of 50 KHz or more using FIG. 7 which is an illustrative curve to show operating characteristics of the core in the circuit in FIG. 6 where a control DC-current Ic flows in the control circuit, before we explain other embodiments of the invention. As shown in FIG. 6, three kinds of wires NL, Nc and Nv are wound on the sample core. The wire $N_L$ corresponding to an out-put wire in an actual magnetic amplifier is connected to an AC source Eg of a frequency f (Period Tp) via a resistance $R_L$ and a rectifier D. The value of Eg should be so big to saturate the magnetic core by an impressed voltage at a phase angle of less than 90° of a sine type of voltage during the half-period of the gate Tg.

Figure 7:
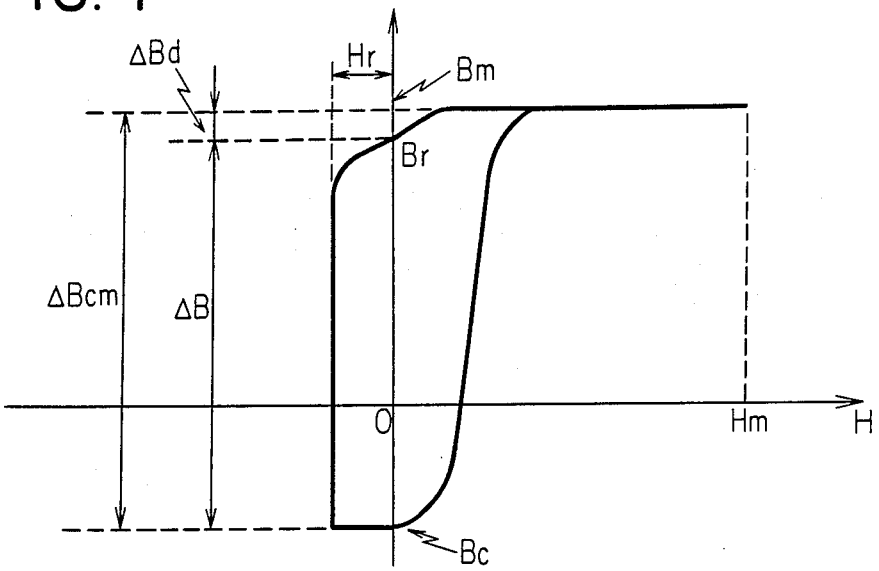
FIG. 7 shows an illustrative B-H curve for a control by a magnetic core.
Figure 8:
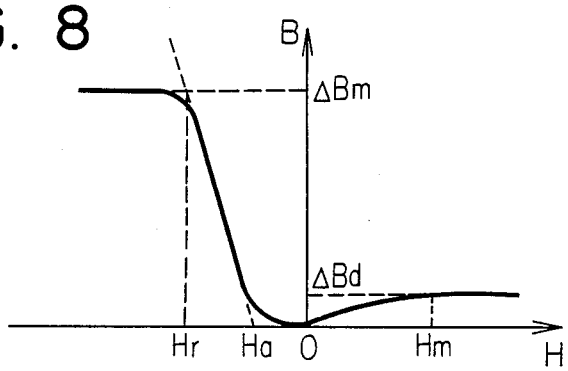
FIG. 8 shows an illustrative curve of magnetization characteristics of a magnetic core.

The wound wire for a controll Nc connected with a DC power source $E_c$ via an inductance $L_c$ which is sufficiently big compared with the inductance of the core observed from the controll circuit produces a DC magnetomotive force to the core under a controlled condition. The wound wire $N_c$ for a measurement of the re-set magnetic flux $\Delta\phi$cm which corresponds to the controlled input current is connected with a mean value rectification type of AC voltmeter (V). A typical characteristic curve of the controlled magnetization examined by the circuit in FIG. 6 is shown in FIG. 7. We express a reciprocal of Hr as $\beta$o, so $\beta$o is equal to 1/Hr. A magnetic core provided with a bigger $\beta$o (a smaller Hr) has a better characteristic for a controll because of a smaller controlling current.

The rectangularity of the magnetization characteristics of a core can be expressed by $\alpha$o which is defined by a formula, $$\alpha o = 1 - \Delta Bd/\Delta Bm.$$

A magnetic core provided with a bigger $\alpha$o (a smaller $\Delta$Bd/$\Delta$Bm value) has a better magnetization characteristic because of a less magnetic flux density which is uncontrollable. Because of the mentioned definitions, a magnetic core provided with a bigger specific core gain wherein $\alpha$o is defined by a formula, $$Go = \alpha o.\beta o$$

is generally more excellent.

If we define $\Delta$Bcm is equal to the difference between the maximum value of the magnetic flux density Bm and the controlled value of the magnetic flux density Bc where Bm and Bc correspond respectively to the maximum value of a gate magnetic field in FIG. 4 expressed as $$Hm = N_L.i_L(max)/le \quad (1)$$

where le is the mean length of magnetic path in the sample core, and the controlled magnetic field defined by a formula, $$Hr = N_c.I_c/le \quad (2)$$

the voltage measured by the voltmeter (V) in the $N_v$-circuit can be expressed as $$E_v \alpha f.N_v.A.Bcm \quad (3)$$

where A means the effective cross section area of the core and f is the frequency in a case that the period is Tp.

In an actual case, it is necessary to observe the Hm-$\Delta$Bd characteristics of the core in a positive magnetic field area and also the Hr-$\Delta$B characteristics of the core in a negative magnetic field area. As $\Delta$Bd is expressed as $$\Delta Bd = Bm - Br \quad (4)$$

the $E_{vd}$ is expressed as $$E_{vd} \alpha f.N_v.A.Bd \quad (5)$$

and $\Delta$B can be expressed as $$\Delta B = Bcm - \Delta Bd \quad (6)$$

As understood from the above stated matters, a preferable core is provided with a curve located near to the bottom in the first quadrant and a curve located near to the vertical axis and strongly inclined in the second guadrant in FIG. 4.

EXAMPLE 6

Six kinds of magnetic cores comprising a wound amorphous metal alloy ribbon according to the present invention were kept at a temperature above the Curie temperature, cooled through the Curie temperature in an AC magnetic field of 1 Oe, the direction of which is generally coincident with the magnetic path in the core and then treated by a stage-aging as shown in FIG. 1(*a*) during a temperature below the Curie temperature to 150° C. The Go values measured in a 50 KHz of AC magnetic field of the cores are shown in Table 1' together with other reference cores treated by a one-stage aging.

Although Si is effective to reduce the iron loss of the core, an excess addition of Si causes a reduction of the Curie temperature (Tc) and the rectangular ratio (Br/Bs) extremely. The proper amount of Si is a value of 13 at % to 16 at %.

The B amount should be a value of 7.5 at % to 9.5 at %, because it is difficult to obtain the alloy in an amorphous states if the B amount is less than 7.5 and on the contrary the saturation flux density (Bs) would be lowered if the B amount exceeds 9.5 %.

TABLE 1

| | Go(m/A) |
|---|---|
| Multiple Stage Aging | |
| Alloy Composition | |

TABLE 1-continued

| | Go(m/A) |
|---|---|
| $(Co_{0.895}Fe_{0.025}Mn_{0.05}Mo_{0.03})_{76}Si_{15}B_9$ | 0.150 |
| $(Co_{0.87}Fe_{0.04}Mn_{0.08}Mo_{0.01})_{75.5}Si_{16}B_{8.5}$ | 0.148 |
| $(Co_{0.89}Fe_{0.03}Mn_{0.05}Mo_{0.03})_{76}Si_{14.5}B_{9.5}$ | 0.143 |
| $(Co_{0.90}Fe_{0.02}Mn_{0.04}Mo_{0.04})_{78}Si_{14}B_8$ | 0.146 |
| $(Co_{0.90}Fe_{0.01}Mn_{0.06}Mo_{0.03})_{75.5}Si_{15.5}B_9$ | 0.149 |
| $(Co_{0.89}Fe_{0.04}Mn_{0.03}Mo_{0.04})_{77.5}Si_{15}B_{7.5}$ | 0.145 |
| One Stage Aging | |
| Conventional Alloy | |
| Anisotropic 50 wt %-Permalloy | 0.013 |
| (Ni) | |
| (Ni) | |
| 80 wt %-Permalloy | 0.05 |
| $Co_{70.5}Fe_{4.5}Si_{15}B_{10}$ Amorphous | 0.056 |
| $Fe_{40}Ni_{35}Si_{10}B_{15}$Amorphous | 0.026 |
| $Co_{66.8}Fe_{4.5}Ni_{1.5}Nb_{2.2}Si_{10}B_{15}$ Amorphous | 0.075 |

EXAMPLE 7

Two kinds of heat-treatments were conducted for the five alloy compositions of cores according to the present inventions. One of them is a multi-stage aging comprising three steps of keepings in a magnetic field and another is a one step of keeping in a magnetic field. The Go-values of cores measured in a 50 KHZ of AC manetic field were measured. The experimental results are shown in Table 2.

TABLE 2

| | Heat-treatment | |
|---|---|---|
| Composition (at %) | Multistage Aging Go(m/A) | One Step Aging Go(m/A) |
| $(Co_{0.868}Fe_{0.033}Mn_{0.066}Mo_{0.033})_{76}Si_{15}B_9$ | 0.140 | 0.100 |
| $(Co_{0.89}Fe_{0.02}Mn_{0.07}Mo_{0.02})_{77}Si_{14}B_9$ | 0.142 | 0.098 |
| $(Co_{0.88}Fe_{0.01}Mn_{0.08}Mo_{0.03})_{77.5}Si_{13}B_{9.5}$ | 0.148 | 0.099 |
| $(Co_{0.915}Fe_{0.005}Mn_{0.07}Mo_{0.01})_{75.5}Si_{16}B_{8.5}$ | 0.150 | 0.098 |
| $(Co_{0.92}Fe_{0.01}Mn_{0.03}Mo_{0.04})_{75.5}Si_{15.5}B_9$ | 0.145 | 0.101 |

Although these alloy compositions of cores according to the invention are provided with excellent Go characteristics, the multi-stage aging is more effective to enhance the Go-values of the cores.

EXAMPLE 8

Two kinds of heat-treatments in a magnetic field were conducted for cores comprised of an amorphous metal ribbon having a composition formula:

$$(Co_{0.942-b}Fe_{0.025}Mn_bMo_{0.03})_{76}Si_{15}B_9.$$

Figure 9:
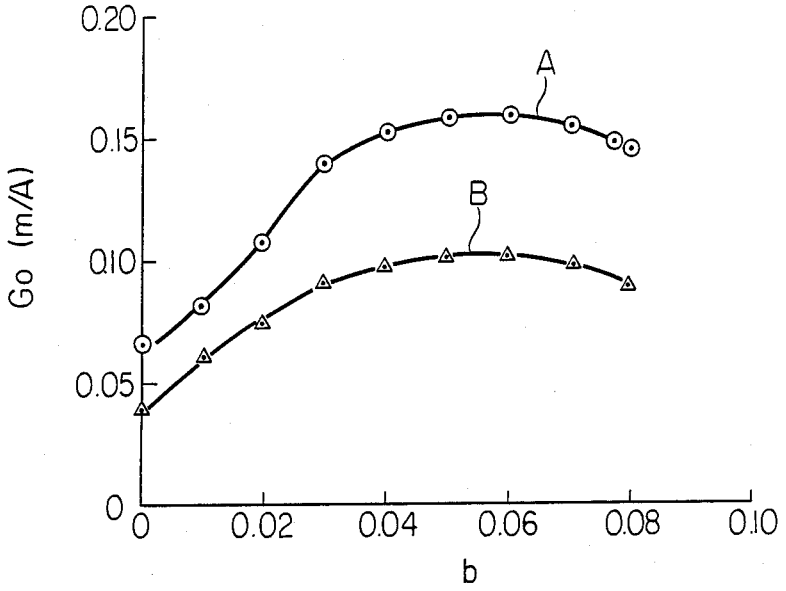
FIG. 9 is a diagram showing relationship between changes in specific core gain Go measured in an AC magnetic field of 50 KHz and the amount (b) of Mn in an alloy system $(Co_{0.942-b}Fe_{0.025}Mn_bMo_{0.03})_{76}Si_{15}B_9$.

One of them is the three-steps of aging and the other is one step of aging. The Go-values of the cores produced by the treatments are shown ih FIG. 9 where the curve A shows the Go-values versus b-value of Mn of the core treated by the multi-stage aging and the curve B shows the Go-values versus b-value of Mn. As shown in FIG. 9, the Go-value of the core increases as b-value increases. Although the cores can be provided with a sufficiently big Go-value by the one-step of aging below the Curie temperature of the alloy, the multistage aging treatment is more preferable. As the b-value of Mn exceeds 0.08, the produced amorphous metal ribbon is too brittle, the preferable b-value is one of 0.03 to 0.08.

EXAMPLE 9

Figure 10:
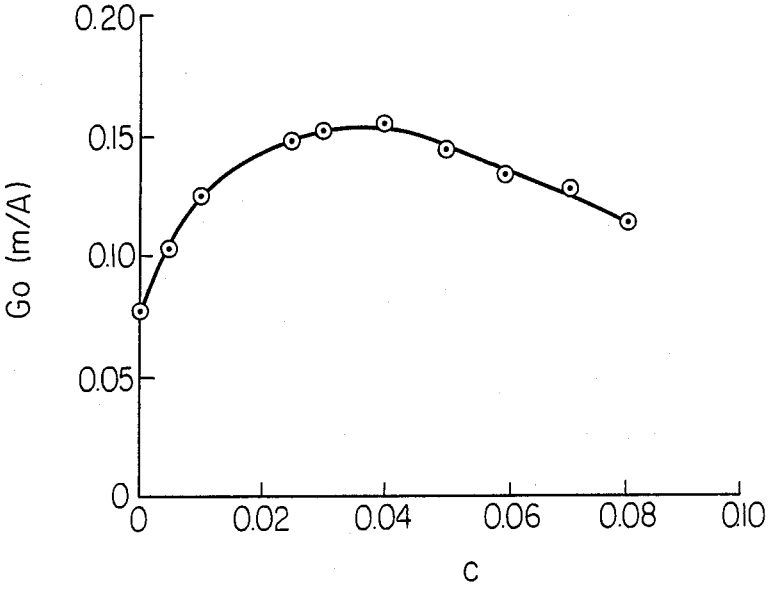
FIG. 10 is a diagram showing relationship between changes in specific core gain Go measured in an AC magnetic field of 50 KHz and the amount (c) of Mo in an alloy system $(Co_{0.918-c}Fe_{0.005}Mn_{0.007}Mo_c)_{76}Si_{15}B_9$.

Magnetic cores comprised of amorphous metal ribbon having a composition of formula:

$$(Co_{0.918-c}Fe_{0.005}Mn_{0.077}Mo_c)_{76}Si_{15}B_9$$

where the c-value of Mo is variable were prepared by the three steps of aging treatment as in Example 8. The Go-value dependence on the c-value of Mn measured in a 50 KHz of magnetic field is shown in FIG. 10. As shown in FIG. 10, Go-value increases rapidly when c-value exceeds 0.01 which is preferable to be provided to the cores. But the saturation flux density becomes a value of a Ferrite material or less when the c-value exceeds 0.04. With regard to Co-amount and Fe-amount, the following comments are necessary to understand the invention. A Fe-substitution or Mn-substitution for Co in a Co-base amorphous alloy is effective to produce a small magnetostriction of alloys for cores. Although the Fe-substitution for Co in a Co-base amorpous alloy is effective to enhance the saturation flux density Bs, an excess Fe-addition as a-value exceeds 0.05 causes a big disaccomodation of magnetic characteristics.

EXAMPLE 10

Six cores having the same composition $(Co_{0.93}Fe_{0.03}Mn_{0.04})_{73}Mo_3Si_{15}B_9$ were respectively treated in a different numbers of steps aging in a magnetic field. The Go-values of the cores measured in a 50 KHz of magnetic field are shown in Table 3. The Go-value increases as the number of the steps increases.

TABLE 3

| Number of Steps | Go(m/A) |
|---|---|
| 1 | 0.110 |
| 2 | 0.115 |
| 3 | 0.140 |
| 4 | 0.150 |
| 5 | 0.150 |
| 6 | 0.148 |

EXAMPLE 11

We conducted rather complicated three steps of aging treatments for magnetic cores comprised of different compositions of alloys in a magnetic field where the aging time is longer as the aging temperature is lower. The keeping time at the each step is 10 minutes, 60 minutes and 240 minutes respectively. Reference cores were produced by a constant time of three steps aging, where the constant keeping time was 10 minutes. We measured the rate of change Go of the Go-value as defined by the formula, $$\Delta Go=(Go^{10000}-Go^{\circ})/Go^{\circ}\times 100$$

where $Go^{\circ}$ is the initial value and $Go^{10000}$ is the final value after 10000 hours. The experimental-results are shown in Table 4.

TABLE 4

| | Go(%) | |
|---|---|---|
| Composition (at %) | Variable Time of Aging | Constant |
| $(Co_{0.91}Fe_{0.03}Mn_{0.03}Mo_{0.03})_{76}Si_{15}B_9$ | 0.21 | 0.82 |
| $(Co_{0.90}Dw_{0.01}Mn_{0.05}Mo_{0.04})_{76.5}Si_{14}B_{9.5}$ | 0.30 | 0.91 |
| $(Co_{0.89}Fe_{0.02}Mn_{0.07}Mo_{0.02})_{78.5}Si_{13}B_{8.5}$ | 0.15 | 0.65 |
| $(Co_{0.89}Fe_{0.01}Mn_{0.06}Mo_{0.04})_{75}Si_{16}B_9$ | 0.24 | 0.88 |

As shown in Table 4, the complicated treatment is preferable to obtain excellent characteristics of cores.

EXAMPLE 12

Figure 11:
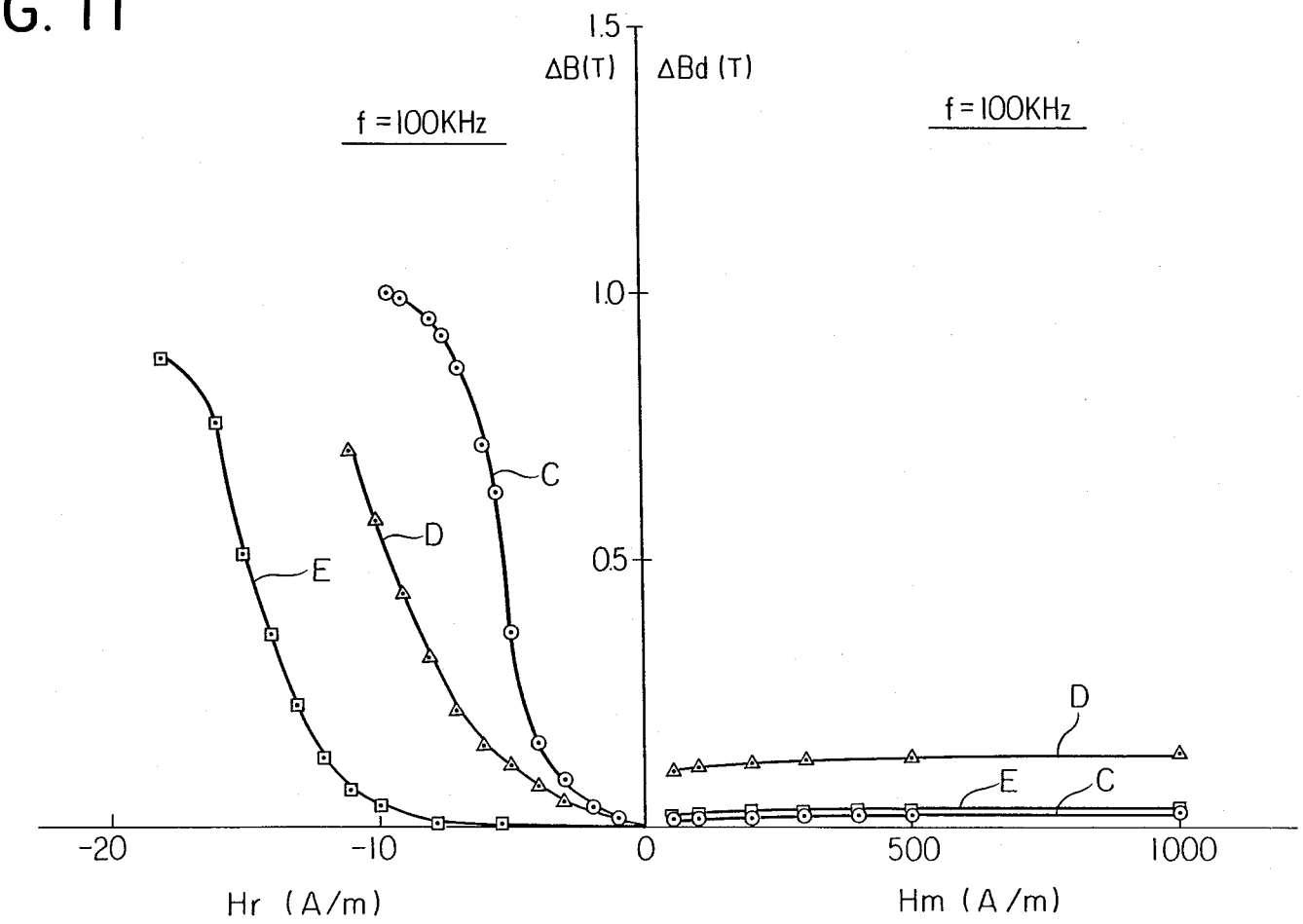
FIG. 11 graphically shows the magnetization characteristics of a magnetic core according to the invention in comparision with the referential magnetic core.

Three types of cores were produced and examined to study the controlled magnetization characteristics: (ΔB-Hr characteristics, ΔBd-Hm characteristics) of the cores. The experimental results are shown in FIG. 11, where the curve C represents the characteristics of a core comprised of a wound amorphous metal ribbon having a composition: $(Co_{0.87}Fe_{0.04}Mn_{0.05}Mo_{0.04})_{76}Si_{15}B_9$ and heat-treated by a three steps of aging, the curves D and E are the characteristics of the cores respectively having a composition of $Co_{70.3}Fe_{5.4}Nb_{1.6}Si_{8.0}B_{14.7}$ and $Co_{69.5}Fe_{4.5}Mo_1Si_{15}B_{10}$, heat-treated by one-step aging.

As shown in FIG. 11, the curve of ΔB-Hr characteristics of the invention (C) located near the vertical axis compared with the curve D or E in the second quadrant, provided with a smaller control current than one of the conventional cores.

On the other hand, the curve of ΔBd-Hm characteristics of the invention (C) is located near the horizontal axis compared with the curve D or E in the first quadrant, provided with an excellent rectangularity compared with the conventional cores.

As described above, the magnetic cores by the present invention has excellent characteristics preferable for a saturable reactor to be incorporated in a magnetical amplifier type of switching power source to be moved in a high frequency of magnetic field of 100 KHz or more because of a low coercive force (Hc) in an alternating-current magnetic field and an extremely small iron loss (W).

In consequence, the magnetic cores according to this invention is provided with a low coercive force (Hc) in an alternating-current B-H curve, a low iron loss (W), a high rectangular ratio and a low disaccommodation of the characteristics which are useful for a reactor component to be driven in a high frequency magnetic field in a magnetical amplifier type of switching power source.

By the present invention we can produce magnetic cores provided with much improved magnetization characteristics of cores having a small control current and a low temperature rise of the core, an excellent rectangularity and a low disaccomodation of the characteristics.

What is claimed is:

1. A manufacturing process of a magnetic core comprising the steps of:

(a) producing an amorphous metal ribbon having the composition formula:

$$(Co_{1-a-b-c}Fe_aMn_bMo_c)_{100-x-y}Si_xB_y \text{ (in atomic \%)}$$

wherein a, b, c, x and y are numbers which respectively satisfy relations $0 \leqq a \leqq 0.05$, $0.03 \leqq b \leqq 0.08$, $0.01 \leqq c \leqq 0.04$, $0.04 \leqq b+c \leqq 0.10$, $14 \leqq x \leqq 16$ and $7.5 \leqq y \leqq 9.5$, by a rapid quenching of the molten metal on a rotating chill surface;

(b) winding a predetermined length of the amorphous metal ribbon into a toroidal shape of core;

(c) keeping the core at a temperature above the alloy's Curie temperature (Tc) of the alloy;

(d) slowly cooling the core through the Curie temperature (Tc) in a DC or AC magnetic field, the direction of which is generally coincidental with the direction of the magnetic path in the core, where the cooling rate is a value of 0.1° C./minute to 50° C./minute;

(e) keeping the core at least one time at a temperature between 0.95×Tc and 150° C. for one hour to ten hours in a magnetic field, the direction of which is generally coincidental with the direction of the magnetic path in the core; and (f) cooling the core to a room temperature.

2. A manufacturing process of a magnetic core according to claim 1, wherein the step (e) in the process comprises a multi-stage heat-treatment for the core which is characterized in that the core is kept at subsequently lower temperatures between 0.95×Tc and 150° C. for a time of one hour to ten hours in a magnetic filed, the direction of which is generally concidental with the direction of the magnetic path in the core.

3. A manufacturng process of a magnetic core according to claim 2, wherein the multi-stage heat-treatment for the core is characterized in that the core is kept at a subsequently lower temperatures beteen 0.95×Tc and 150° C. for a time of one hour to ten hours which is longer as the temperature is lower, in a magnetic field, the direction of which is generally coincidental with the direciton of the magnetic path in the core.

* * * * *